US010378208B2

(12) United States Patent
Sun et al.

(10) Patent No.: US 10,378,208 B2
(45) Date of Patent: Aug. 13, 2019

(54) STEEL-FIBER COMPOSITE MATERIAL CONCRETE COMBINED COLUMN, AND POST-EARTHQUAKE REPAIR METHOD THEREOF

(71) Applicant: SOUTHEAST UNIVERSITY, Nanjing (CN)

(72) Inventors: Zeyang Sun, Nanjing (CN); Gang Wu, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 15/769,771

(22) PCT Filed: Mar. 30, 2017

(86) PCT No.: PCT/CN2017/078696
§ 371 (c)(1),
(2) Date: Apr. 20, 2018

(87) PCT Pub. No.: WO2017/185942
PCT Pub. Date: Nov. 2, 2017

(65) Prior Publication Data

US 2018/0305929 A1 Oct. 25, 2018

(30) Foreign Application Priority Data

Apr. 29, 2016 (CN) ..... 2016 1 0281873

(51) Int. Cl.
*E04C 3/36* (2006.01)
*E01D 19/02* (2006.01)
(Continued)

(52) U.S. Cl.
CPC ..... *E04C 3/36* (2013.01); *E01D 19/02* (2013.01); *E01D 22/00* (2013.01); *E04B 1/30* (2013.01);
(Continued)

(58) Field of Classification Search
CPC . E04C 3/36; E04C 5/0622; E04C 5/04; E04C 3/34; E04H 9/024; E04H 9/025;
(Continued)

(56) References Cited

U.S. PATENT DOCUMENTS 9,708,821 B1 * 7/2017 Azizinamini ..... E04G 23/0218
2008/0155827 A1 * 7/2008 Fyfe ..... E04G 23/0218 29/897.1
(Continued)

FOREIGN PATENT DOCUMENTS

CN 202117165 U * 1/2012
CN 102409606 A * 4/2012
(Continued)

OTHER PUBLICATIONS

English Translation of International Preliminary Report on Patentability Chapter I for PCT/CN2017/078696 (6 pages). (Year: 2018).*

*Primary Examiner* — Rodney Mintz
(74) *Attorney, Agent, or Firm* — CBM Patent Consulting, LLC

(57) ABSTRACT

A steel-fiber reinforced polymer (FRP) composite material reinforced concrete column comprises an inner steel pipe arranged in the center, wherein the inner steel pipe is internally provided with an unbonded steel strand; the outside of the inner steel pipe is provided with an outer steel pipe, concrete is poured between the inner steel pipe and the outer steel pipe, a plurality of additional small steel pipes are evenly arranged outside the outer steel pipe, and each of the additional small steel pipes is internally provided with an additional unbonded steel strand. A composite bar cage coaxial with the outer steel pipe and arranged on the outside thereof is also provided, wherein both the outer steel pipe and the composite bar cage are covered by high-ductility
(Continued)

concrete, and at a core area, the outside of the high-ductility concrete is wrapped with an anti-spalling layer.

6 Claims, 4 Drawing Sheets

(51) Int. Cl.

| | |
|---|---|
| ***E01D 22/00*** | (2006.01) |
| ***E04G 23/02*** | (2006.01) |
| ***E04C 3/34*** | (2006.01) |
| ***E04B 1/30*** | (2006.01) |
| ***E04C 5/04*** | (2006.01) |
| ***E04C 5/06*** | (2006.01) |
| ***E04C 5/01*** | (2006.01) |
| ***E04H 9/02*** | (2006.01) |

(52) U.S. Cl.
CPC ..... *E04C 3/34* (2013.01); *E04C 5/015* (2013.01); *E04C 5/04* (2013.01); *E04C 5/0618* (2013.01); *E04C 5/0622* (2013.01); *E04G 23/02* (2013.01); *E04G 23/0218* (2013.01); *E04B 2103/02* (2013.01); *E04B 2103/06* (2013.01); *E04G 2023/0251* (2013.01); *E04H 9/024* (2013.01); *E04H 9/025* (2013.01)

(58) Field of Classification Search
CPC ..... E04G 23/0218; E04G 23/02; E04G 2023/0251; E01D 22/00; E01D 19/02; E04B 2103/06; E04B 1/30; E04B 2103/02
See application file for complete search history.

(56) References Cited

U.S. PATENT DOCUMENTS

| | | | | |
|---|---|---|---|---|
| 2012/0124937 | A1* | 5/2012 | Teng | E04B 5/43 52/834 |
| 2015/0113913 | A1* | 4/2015 | Kim | E04C 3/34 52/834 |
| 2015/0167332 | A1* | 6/2015 | Shiota | E04G 23/0218 52/514 |
| 2016/0097199 | A1* | 4/2016 | Saiidi | E01D 19/02 52/126.7 |
| 2017/0191279 | A1* | 7/2017 | Azizinamini | E04G 23/0218 |
| 2017/0198477 | A1* | 7/2017 | Ehsani | E04C 3/04 |
| 2017/0241140 | A1* | 8/2017 | Teng | E04C 3/34 |
| 2017/0268245 | A1* | 9/2017 | Azizinamini | E04G 23/0218 |
| 2018/0187439 | A1* | 7/2018 | Oliveira De Barros | E04G 23/0218 |
| 2019/0169846 | A1* | 6/2019 | Azizinamini | E04C 3/34 |

FOREIGN PATENT DOCUMENTS

| | | | | |
|---|---|---|---|---|
| CN | 202689338 | U | * | 1/2013 |
| CN | 103074847 | A | * | 5/2013 |
| CN | 104562922 | A | * | 4/2015 |
| CN | 204589789 | U | * | 8/2015 |
| CN | 105442755 | A | * | 3/2016 |
| CN | 106284844 | A | * | 1/2017 |
| CN | 106869569 | A | * | 6/2017 |
| KR | 20080000243 | A | * | 1/2008 |
| KR | 20100102907 | A | * | 9/2010 |

* cited by examiner

A-A

STEEL-FIBER COMPOSITE MATERIAL CONCRETE COMBINED COLUMN, AND POST-EARTHQUAKE REPAIR METHOD THEREOF

TECHNICAL FIELD

The present invention relates to the field of civil engineering technologies, and more particularly, to a steel-fiber reinforced polymer (FRP) composite material reinforced concrete column and a post-earthquake repair method thereof.

BACKGROUND

Earthquake is one of the natural disasters bringing major losses of life and property to the human beings, and overlarge residual deformation of a structure is more possible to collapse in an aftershock due to P-Δ effect. Long-span bridges, super high-rise buildings, hospitals, explosive and poisonous buildings, and other important buildings are required to have a certain post-earthquake function except for the security guarantee in earthquake, and can be quickly recovered. After an ordinary reinforced concrete structure is yielded, due to the elastoplasticity of the steel bar, deformation is sharply increased while the improvement on the load carrying capacity is limited; the post-yield stiffness thereof approaches to zero or even negative, thus causing two defects: firstly, under a stable load larger than the yielding load, column damage will be uncontrollable, and the damage is mainly concentrated on a plastic hinge zone near the foot of the column, the post-earthquake residual deformation will be too large, the repair after earthquake is difficult, and it is easier to collapse in an aftershock; and secondly, under the excitation of different earthquake inputs, the post-earthquake residual displacement is separated due to the uncertainty of plastic development, which brings difficulty to quantitative evaluation to the structure damage and risk prevention.

Predication on the residual deformation of the structure under the effect of the earthquake starts to be concerned and considered in the performances based design (PBD), and novel structure systems and new materials are also introduced into earthquake-resistant structure design. Good repairability requires a newly-built structure has the following post-earthquake features: firstly, major components of the structure such as the column are still kept in a good status to satisfy the design idea of strong column and weak beam; and the loss of life and property is little; and secondly, the post-earthquake residual deformation is small, and the repair is quick. A quick post-earthquake repair is especially required for arterial traffics, core buildings and other buildings with high important grade. Studies find that an elastic-plastic system with a hardening feature, i.e., dynamic hardening stiffness in the hysteretic behavior after being yielded has a great impact on the residual displacement of the structure, and using a material with the hardening feature or designing a cross section with stable post-yield stiffness can effectively increase the anti-earthquake response stability and reduce the post-earthquake residual displacement. There are several ways to increase the post-yield stiffness of the structure from the aspect of the cross section of the component: firstly, a material with relatively high stress-strain hardening feature is used; and secondly, the cross section is configured with a reinforcing material having different material properties (such as: mixing of FRP bars and ordinary steel bars, and hybrid FRP bars).

Zhishen Wu and Gang Wu et al studied a hybrid FRP reinforced concrete structure early, and proposed the possibility and necessity of realizing the design of the post-yield stiffness from material to structure, and developed a steel-fiber reinforced polymer composite bar (SFCB) and SFCB reinforced concrete structure thereof. The inner core of an SFCB is steel bar or steel wires, and the outer layer is longitudinally composited with FRP, so that the advantages of the two can be complemented. Since the FRP has the features of high strength, low elastic modulus, poor ductility, good durability and light weight, while the steel material has the features of low strength, high elastic modulus, good ductility, poor durability and heavy weight, the two are strongly complemented, and the SFCB obtained has stable and controllable post-yield stiffness after being yielded. Compared with a steel bar, the density of the SFCB is greatly reduced; compared with the FRP, the stiffness of the SFCB is greatly increased, and the cost is much lower; moreover, the fiber and resin outside the SFCB can also play a role of preventing the steel bar of the inner core from corrosion prevention.

The concrete column longitudinally reinforced by SFCBs has the features as follows. Firstly, under the service loads or the effect of small/moderate earthquakes, the SFCBs does not change the natural vibration period of the structure, has the same strength as that of a common reinforced concrete structure, and the high elasticity modulus of the steel bar of the inner core of the SFCB is fully used. Secondly, the externally covered FRP with linear elasticity makes the structure has stable post-yield stiffness on the aspect of the cross section, i.e., after the inner core steel bar of the SFCB is yielded, the high strength of the externally covered FRP enables the bearing capability of the concrete column to be continuously increased to have the post-yield stiffness. This feature can prevent overlarge plastic deformation in the small scope of the foot of the column, realize even distribution of the curvature in a longer area, and reduce the required curvature of the cross section, so that the plastic strain of the inner core steel bar of SFCB is correspondingly reduced. Thirdly, using the SFCB to replace the common steel bar enables the structure to have the feature of certain durability, which has obvious advantages under high-corrosion and other severe environments than ordinary RC structure. In addition, the bonding performance between the SFCB and the concrete can be controlled, and the technology is simple, which can be used to increase the seismic performance of the structure.

The existing SFCB reinforced concrete structure has the following problems.

The ductility is relatively poor; because the limiting strain of the FRP is generally low, it is difficult to satisfy the high ductility requirement of the structure reinforced.

The ordinary steel bar is still used for confinement (stirrups) in the existing SFCB reinforced concrete structure, and the durability cannot be satisfied yet. However, the target of high durability can be realized by using an FRP hoop and a longitudinal SFCB reinforced concrete column, but due to the linear elasticity feature of the FRP, if the FRP hoop reaches an ultimate strength, a brittle shear failure will occur.

It is still difficult to repair the SFCB reinforced concrete column after earthquake, and under great earthquake, if the rupture of FRP occurs to the concrete column structure with relatively high post-yield stiffness, it is easier to result in structure collapse.

SUMMARY

Object of the invention: in order to overcome the defects in the prior art, the present invention provides a steel-fiber reinforced polymer (FRP) composite material reinforced concrete column and a post-earthquake repair method thereof with relatively high post-earthquake reparability and high durability, which has the main features of stable and controllable post-yield stiffness and small post-earthquake residual displacement, and can realize quick post-earthquake repair. The concrete column can be used in bridge piers and structural columns for buildings, and is suitable for highly corrosive environments such as oceans.

Technical solution: in order to solve the technical problems above, a steel-FRP composite material reinforced concrete column according to the present invention comprises an inner steel pipe arranged in the center, wherein the inner steel pipe is internally provided with an unbonded steel strand; the outside of the inner steel pipe is provided with an outer steel pipe, concrete is poured between the inner steel pipe and the outer steel pipe, a plurality of additional small steel pipes are evenly arranged outside the outer steel pipe, and each of the additional small steel pipes is internally provided with an additional unbonded steel strand; a composite bar cage composed of a plurality of SFCBs and steel wire-FRP spiral hoops coaxial with the outer steel pipe and arranged on the outside thereof is further comprised, both the outer steel pipe and the composite bar cage are covered by high-ductility concrete, and the outside of the high-ductility concrete is wrapped with an anti-spalling layer.

The high-ductility concrete is covered on the core areas of the outer steel pipe and the composite bar cage.

The outer steel pipe in the area covered by the high-ductility concrete is formed by multiple steel pipes connected in sequence; the steel pipes between different joints are taken off without bearing a tensile force, and only have a horizontal restrain effect on covered concrete.

The anti-spalling layer is FRP.

The plurality of SFCBs located in the high-ductility concrete have unbonded sections.

A plurality of the additional small steel pipes are arranged and are evenly disposed outside the steel pipe in a circular pattern, and can be used for quick post-earthquake restoration.

A post-earthquake repair method for A steel-FRP composite material reinforced concrete column comprises the following steps of:

S1: stretching and drawing the additional unbonded steel strands in each of the additional small steel pipes and the unbonded steel strand in the inner steel pipe to enable the combined column to recover to a displacement status before earthquake;

S2: eliminating damaged concrete in the core area of the concrete combined column until the outer steel pipe is exposed, using a steel plate to cover and confine the outside of the outer steel pipe, welding the upper end of the steel plate with the outer steel pipe, and putting the lower end deep into a column platform for anchorage;

S3: implanting a new steel-FRP composite bar or a stainless steel bar in a damaged area if the FRP of the SFCB is damaged, connecting the upper end to the original SFCB by means of mechanical anchorage and bonded anchorage in a combined manner, implanting the lower end with a bonded sleeve into a column platform anchorage area. If the stainless steel bar is implanted, arranging a pier head anchor at the end part of the stainless steel bar, and grouting for anchorage;

S4: confining the steel-FRP bar/stainless steel bar implanted in the core area by a steel wire rope;

S5: pouring high-ductility concrete in the core area; and

S6: wrapping FRP outside the high-ductility concrete poured in the core area in step S5, wherein the covering scope is larger than the scope of the high-ductility concrete poured to guarantee that the upper anchorage area of the newly implanted steel-FRP bar/stainless steel bar is in the bonded scope, and then finishing the repair.

Beneficial effects: the steel-FRP composite material reinforced concrete column according to the present invention has relatively high post-earthquake reparability, which has the main features of stable and controllable post-yield stiffness and small post-earthquake residual displacement, and can realize quick post-earthquake repair. The concrete column can be used in bridge piers and structural columns for buildings, and is suitable for highly corrosive environments such as oceans. A repair method is further provided, which can quickly repair the damaged concrete combined column.

DETAILED DESCRIPTION

The present invention is further described hereinafter with reference to the drawings.

Figure 1:
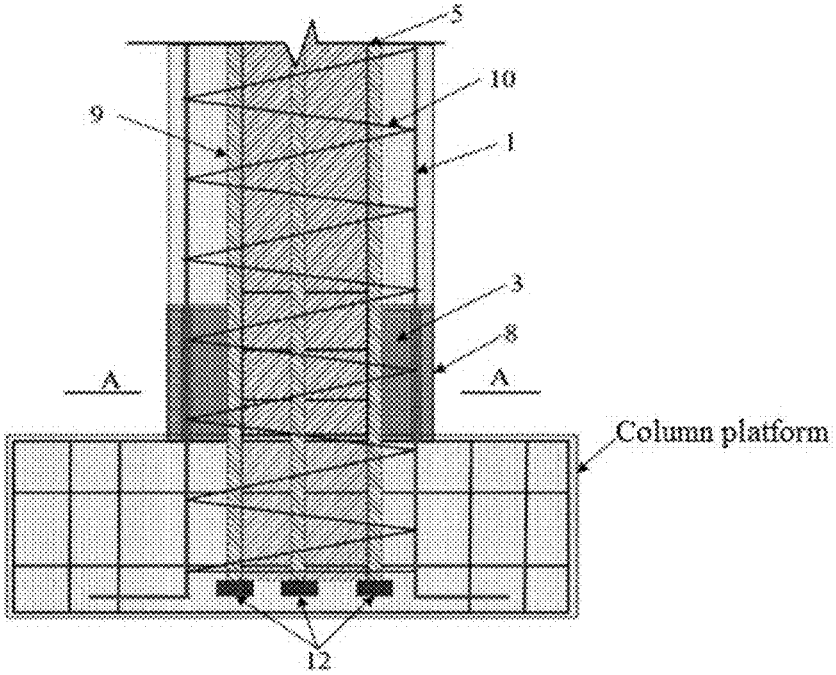
FIG. 1 is a schematic diagram of a steel-FRP composite material reinforced concrete column and a column platform according to the present invention.
Figure 2:
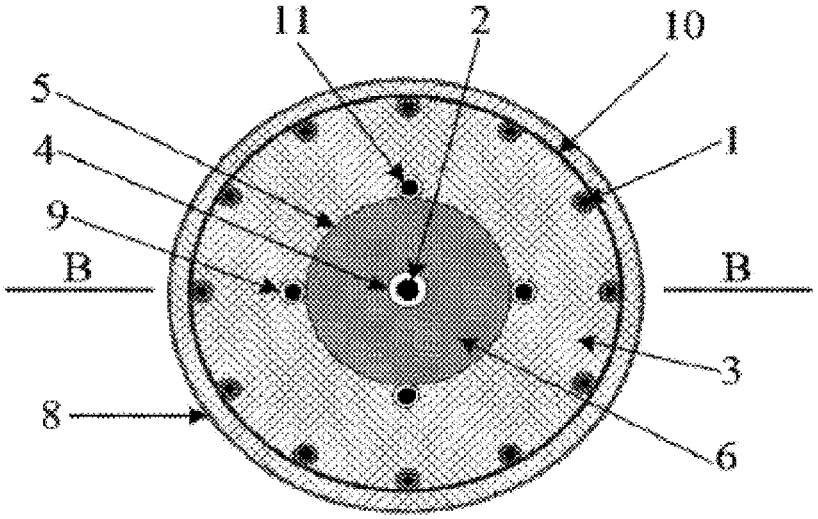
FIG. 2 is a schematic diagram of n A-A cross section in FIG. 1.
Figure 3:
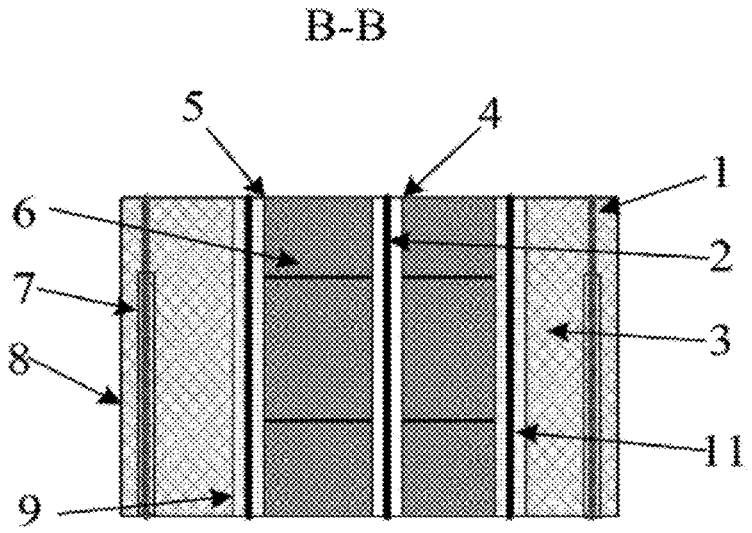
FIG. 3 is a schematic diagram of a B-B cross section at a core area in FIG. 2.
Figure 4:
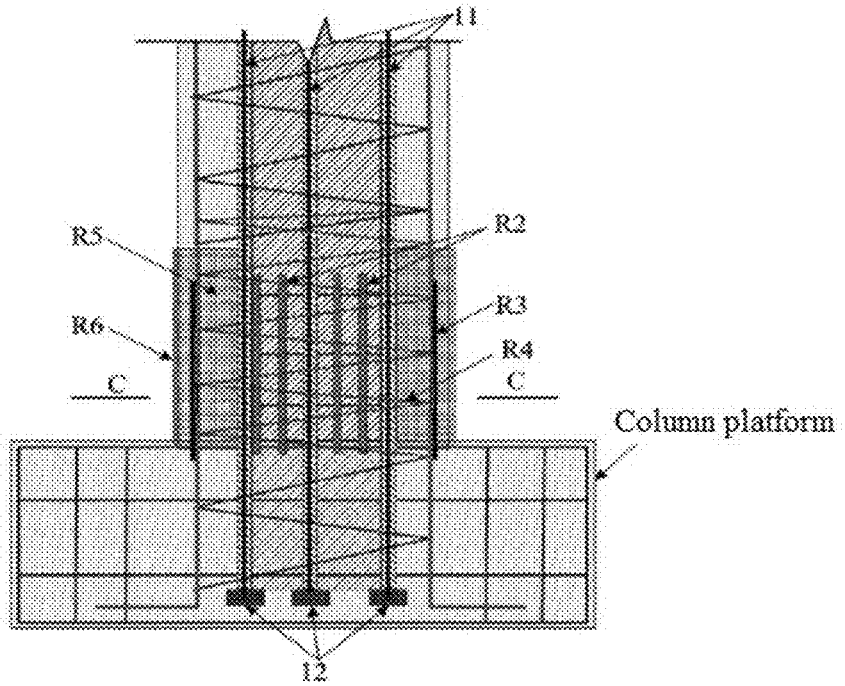
FIG. 4 is a schematic diagram of conducting post-earthquake repair to the combined column based on the configuration as shown in the figure.
Figure 5:
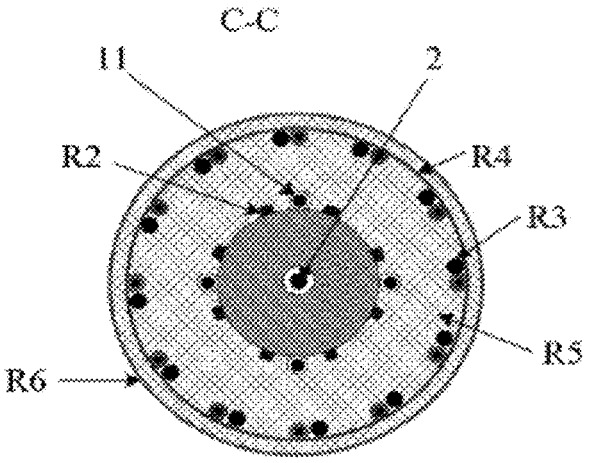
FIG. 5 is a schematic diagram of a C-C cross section in FIG. 4.

As shown in FIG. 1 to FIG. 3, a steel-FRP composite material reinforced concrete column comprises an inner steel pipe 4 arranged in the center, and the inner steel pipe 4 is internally provided with an unbonded steel strand 2; the outside of the inner steel pipe 4 is provided with an outer steel pipe 5 coaxial with the inner steel pipe, concrete 6 is poured between the inner steel pipe 4 and the outer steel pipe 5, a plurality of additional small steel pipes 9 are evenly arranged outside the outer steel pipe 5, and each of the additional small steel pipes 9 is internally provided with an additional unbonded steel strand 11; a composite bar cage coaxial with the outer steel pipe 5 and arranged on the outside thereof is further comprised, both the outer steel pipe 5 and the composite bar cage are covered by high-ductility concrete 3, the outside of the high-ductility concrete 3 is wrapped with an anti-spalling layer 8, and the anti-spalling layer 8 is FRP. The high-ductility concrete 3 is only covered on the core areas of the outer steel pipe 5 and the composite bar cage, the core area is a plastic hinge area of the concrete combined column, the high-ductility concrete can be used in the whole concrete combined column, or used in the core area only. The outer steel pipe 5 in the covered area of the high-ductility concrete 3 is formed by multiple steel pipes connected in sequence, so that the outer steel pipe of the core area only plays a role of restraining the core concrete instead of making longitudinal bending resistance contributions. The composite bar cage is composed of a plurality of SFCBs 1 in the high-ductility concrete and steel wire-FRP spiral hoops 10. The plurality of SFCBs 1 located in the high-ductility concrete 3 have unbonded sections. An anti-buckling sleeve 7 is sleeved outside the SFCBs 1, and the SFCBs 1 located in the anti-buckling sleeve 7 are the unbonded sections, which are convenient for stretching and drawing in post-earthquake repair. Four additional small steel pipes 9 are arranged and are evenly disposed outside the steel pipe 5 in a circular pattern.

The steel-FRP composite material reinforced concrete column according to the present invention is combined with the column platform into an integrity, the lower part thereof is the core area, the upper part of the core area is an elastic region, the core area is poured by the high-ductility concrete, the high-ductility concrete is not used in the elastic region, part of the combined column is fixed in the column platform, and each SFCB 1 stretches from the bottom part of the combined column and is provided with an anchor head 12. The post-yield stiffness of the SFCB 1 can control the earthquake displacement response of the combined column, the prestress unbonded steel strand 2 in the center can reduce the residual displacement during the earthquake, the high-ductility concrete 3 in the core area with large compressive strain and the unbonded sections of the SFCBs 1 can make the SFCBs 1 strained evenly to avoid tension rupture. The concrete 6 is restrained by the inner steel pipe 4 and the outer steel pipe 6, the outer steel pipe 5 is divided into multiple segments at the core area, so that the outer steel pipe 5 in the core area only plays a role of restraining the high-ductility concrete of the core area without making longitudinal anti-bending contributions. The core area is ensured to not have excessive plastic deformation in rare earthquakes by designing, so as to guarantee the axial bearing capacity and provide key supports to the quick post-earthquake restoration and maintenance of the plastic hinge area; and the outside of the high-ductility concrete in the core area is provided with a horizontal anti-spalling layer 8, which increases the ductility of the high-ductility concrete while avoiding the buckling of the unbonded regions of the SFCBs 1 due to the spalling of the concrete. For the SFCBs, avoiding the buckling can guarantee the tension/compression strength, and when the externally covered FRP is not used in the core area for restraining, the anti-buckling sleeve 7 is used to realize the unbonded SFCBs. The steel wire-FRP spiral hoops 10 are used as the hoops to completely realize that the combined column can be qualified to oceanographic engineering and other high corrosion environments.

The present invention further provides a post-earthquake repair method for a steel-FRP composite material reinforced concrete column, which comprises the following steps of:

S1: stretching and drawing the additional unbonded steel strands in each of the additional small steel pipes and the unbonded steel strand in the inner steel pipe to enable the combined column to recover to a displacement status before earthquake;

S2: eliminating concrete damaged by various disasters until the outer steel pipe is exposed, connecting the section-type outer steel pipe into an integrity capable of stretching and restraining vertically, wherein the connecting method can be the use of a steel lathing, welding the upper end of the steel plate with the outer steel pipe, and putting the lower end deep into a column platform for anchorage;

S3: implanting a new steel-FRP composite bar or a stainless steel bar in a damaged area if the FRP of the SFCB is damaged, connecting the upper end to the original SFCB by means of mechanical anchorage and bonded anchorage in a combined manner, implanting the lower end with a bonded sleeve into a column platform anchorage area, arranging a pier head anchor at the end part of the stainless steel bar if the stainless steel bar is planted, and grouting for anchorage;

S4: confining the steel-FRP bar/stainless steel bar implanted in the core area by a steel wire rope (the steel wire rope is similar as stirrup);

S5: pouring high-ductility concrete in the core area; and

Figure 6:
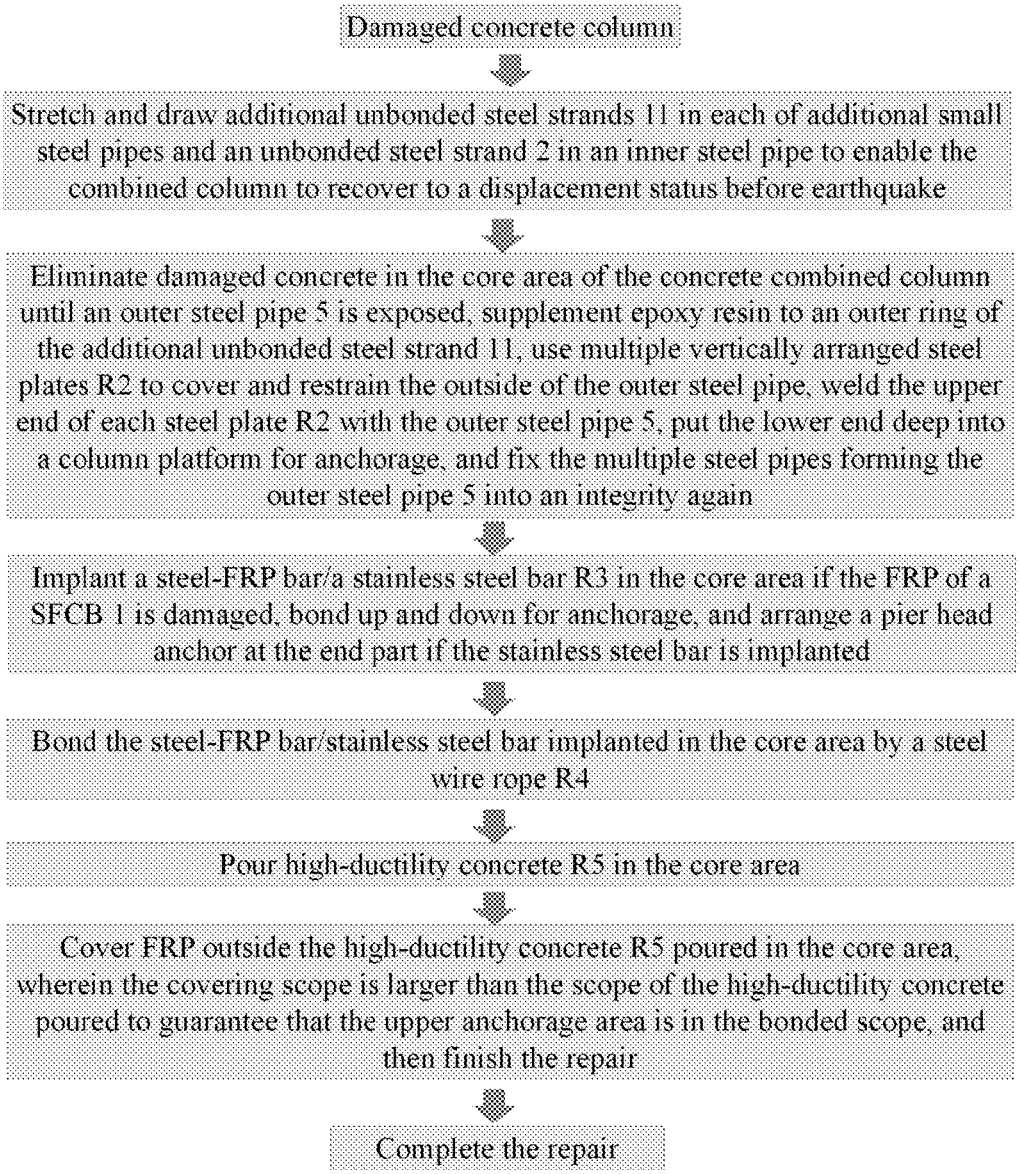
FIG. 6 is a post-earthquake repair process of the combined column.

S6: wrapping FRP outside the high-ductility concrete poured in the core area in step S5, wherein, as shown in FIG. 6, the wrapping scope is larger than the scope of the high-ductility concrete poured to guarantee that the upper anchorage area of the newly implanted steel-FRP bar/stainless steel bar is in the confined scope, and then finishing the repair.

The contents above are only preferred embodiments of the invention. It shall be pointed out that those skilled in the art can make a plurality of improvements and polishing without departing from the principle of the invention, which shall also fall within the protection scope of the invention.

What is claimed is:

1. A steel-fiber reinforced polymer (FRP) composite material reinforced concrete column, comprising an inner steel pipe arranged in the center, wherein the inner steel pipe is internally provided with an unbonded steel strand; outside of the inner steel pipe is provided with an outer steel pipe, concrete is poured between the inner steel pipe and the outer steel pipe, a plurality of additional small steel pipes are evenly arranged outside the outer steel pipe, and each of the additional small steel pipes is internally provided with an additional unbonded steel strand; a composite bar cage composed of a plurality of steel-fiber reinforced polymer composite bars (SFCBs) and steel wire-FRP spiral hoops coaxial with the outer steel pipe and arranged on the outside thereof is further comprised, both the outer steel pipe and the composite bar cage are covered by high-ductility concrete, and outside of the high-ductility concrete is wrapped with an anti-spalling layer; wherein each of the steel strands are stretched and pulled to recover a damaged section of concrete column; a steel plate is positioned to cover the outside of the outer steel pipe that contains damaged concrete; a respective steel-FRP composite bar or a stainless steel bar is inserted into a damaged section of the SFCB.

2. The steel-FRP composite material reinforced concrete column according to claim 1, wherein the plurality of the additional small steel pipes are arranged and are evenly disposed outside the outer steel pipe in a circular pattern.

3. The steel-FRP composite material reinforced concrete column according to claim 1, wherein the plurality of SFCBs located in the high-ductility concrete have unbonded length.

4. The steel-FRP composite material reinforced concrete column according to claim 1, wherein the high-ductility concrete is covered on core areas of the outer steel pipe and the composite bar cage.

5. The steel-FRP composite material reinforced concrete column according to claim 4, wherein the outer steel pipe in the area covered by the high-ductility concrete is formed by multiple steel pipes connected in sequence.

6. The steel-FRP composite material reinforced concrete column according to claim 4, wherein the anti-spalling layer is FRP.

* * * * *